US009950201B2

(12) United States Patent
Zimmerman et al.

(10) Patent No.: US 9,950,201 B2
(45) Date of Patent: Apr. 24, 2018

(54) ACOUSTIC SENSOR FOR USE IN BREATHING MASKS

(75) Inventors: Paul Zimmerman, Wimborne (GB); Przemyslaw Gostkiewicz, Olsztynek (PL); Leopoldine Bachelard, Chatillon (FR)

(73) Assignee: Zodiac Aerotechnics, Plaisir (FR)

( * ) Notice: Subject to any disclaimer, the term of this patent is extended or adjusted under 35 U.S.C. 154(b) by 1156 days.

(21) Appl. No.: 12/522,193

(22) PCT Filed: Jan. 4, 2007

(86) PCT No.: PCT/IB2007/000523

§ 371 (c)(1),
(2), (4) Date: Jul. 6, 2009

(87) PCT Pub. No.: WO2008/081226

PCT Pub. Date: Jul. 10, 2008

(65) Prior Publication Data

US 2010/0108065 A1 May 6, 2010

(51) Int. Cl.

| | |
|---|---|
| ***A62B 18/02*** | (2006.01) |
| ***A62B 18/08*** | (2006.01) |
| *A62B 7/14* | (2006.01) |

(52) U.S. Cl.

CPC ..... *A62B 18/08* (2013.01); *A62B 7/14* (2013.01)

(58) Field of Classification Search

CPC ..... G10L 2021/02165; G10L 25/78; G10L 21/0208; A62B 18/08; A62B 7/14; H03B 29/00

(Continued)

(56) References Cited

U.S. PATENT DOCUMENTS 3,789,353 A * 1/1974 Hunter et al. ..... 367/132
4,154,981 A * 5/1979 Dewberry ..... H04M 9/08 367/132

(Continued)

FOREIGN PATENT DOCUMENTS

WO WO199737724 10/1997

OTHER PUBLICATIONS

International Patent Application No. PCT/IB2007/000523, International Search Report dated Aug. 23, 2007.

(Continued)

*Primary Examiner* — Kari Rodriquez
*Assistant Examiner* — Victoria Murphy
(74) *Attorney, Agent, or Firm* — Kilpatrick Townsend & Stockton LLP; Dean W. Russell

(57) ABSTRACT

A breathing mask adapted to be placed over a wearer's face, comprises a mask body including a gas inlet port to be disposed in flow communication with the wearer's breathing passage for flow of a gas in a predetermined flow stream there through upon inhalation by the wearer; a communications microphone (30) mounted to said mask body to capture the voice of the wearer, said communications microphone generating sound signals; an attenuation device (34) for attenuating said sound signals; a sound monitor (36) for monitoring the intensity of sound near the communications microphone in a predetermined frequency range, connected to a controller device (38) for activating the attenuation device when the sound intensity monitored by the sound monitor is in a predetermined level range.

13 Claims, 3 Drawing Sheets

(58) Field of Classification Search
USPC ..... 128/201.19, 206.21; 381/72, 74, 110, 381/375, 376, 384, 71.6
See application file for complete search history.

(56) References Cited

U.S. PATENT DOCUMENTS

| | | | | |
|---|---|---|---|---|
| 5,550,925 | A * | 8/1996 | Hori et al. | 381/98 |
| 5,572,990 | A * | 11/1996 | Berlin | 128/201.19 |
| 5,860,417 | A * | 1/1999 | Kettl et al. | 128/201.19 |
| 6,101,256 | A * | 8/2000 | Steelman | 381/91 |
| 6,430,298 | B1 | 8/2002 | Kettl et al. | |
| 7,139,701 | B2 | 11/2006 | Harton et al. | |
| 2002/0134378 | A1* | 9/2002 | Finnegan | A61M 16/00 128/200.24 |
| 2006/0009970 | A1* | 1/2006 | Harton | 704/231 |
| 2006/0291671 | A1* | 12/2006 | Hyatt | 381/110 |
| 2009/0052714 | A1* | 2/2009 | Wilbur | H04B 1/385 381/364 |

OTHER PUBLICATIONS

International Patent Application No. PCT/IB2007/000523, International Preliminary Report on Patentability dated Jul. 7, 2009.

* cited by examiner

ACOUSTIC SENSOR FOR USE IN BREATHING MASKS

CROSS REFERENCE TO RELATED APPLICATIONS

This application is the U.S. national phase of International Application No. PCT/IB2007/000523 filed on Jan. 4, 2007 and published in English on Jul. 10, 2008 as International Publication No. WO 2008/081226 A1, the entire contents of which are incorporated herein in its entirety by reference.

The invention is related to a breathing mask having microphones therein.

Most aircraft are equipped with breathing mask systems to supply oxygen to crew members for use in emergency situations, for instance in oxygen depleted environments during aircraft decompression. In the course of such emergency aircraft operations, pilots, navigation officers and other flight crew personnel may don a breathing mask including a demand breathing regulator and microphone system. It is imperative that the breathing mask includes a microphone so that communication with other crew members or with control tower personnel, during such emergency situation may be maintained.

In most microphone systems, sounds emitted by the wearer activate a microphone which converts received sounds into audio signal for transmission. The sounds received by the microphone include not only the wearer's voice but, unfortunately, background noise as well. When the wearer inhales, the sound of gas flow through the mask's breathing regulator is often particularly loud and is transmitted as noise having a large component comparable in both frequency and intensity to the sounds made by a person when speaking. When one of two or more flight crew members wearing masks is speaking, the noise generated during inhalation by others in the crew can seriously interfere with the hearing or understanding of the crew member speaking. In addition, when the crew members are exposed to stressful emergency conditions, their breathing rate is increased further intensifying the level of noise interference. This interference presents a very serious problem because it is at such time of emergency that effective communication between crew members and the tower is imperative.

Others have endeavoured to overcome the noise interference by incorporating electronic filters and noise dampening means with the microphone systems. However, it has been found that such filters and dampeners also filter out the sounds of speech.

Others have provided breathing masks wherein the microphone includes a noise attenuation structure or microphone deactivation device for reducing the amount of audio signals generated from the microphone by electrically disabling the microphone during inhalation by the wearer.

One such deactivation device has been proposed which incorporates a pair of normally closed contacts carried on a leaf spring, connected in series with the microphone and coupled with an air impingement tab disposed in the gas supply path so that incoming gas will shift such tab against the spring bias to open the contacts and disable the microphone. Such a device suffers the shortcoming that the flow of incoming air to activate the switch may lag the pilot's inhale cycle thus leaving a time lapse before the microphone is cut out when it may pick up his or her inhaling noise. Moreover, the air flow force required to overcome the bias of the contact leaf spring may be considerable and could interfere with smooth and responsive operation.

Another such deactivation device includes a normally closed electromagnetic reed switch device in circuit with the microphone. A movable magnet is disposed in the inhalation air stream of the mask to, upon movement thereof, open the reed switch to disable the microphone. Because such reed switch/magnet devices may be relatively small and require only a minimum of force to operate, such devices have been found desirable for use in breathing mask applications to minimize the bulk of the mask and minimize weight. In this deactivation devices, the magnet is biased by a spring to a normal position spaced from the switch such that during exhalation when the pilot is speaking, the magnetic field of the magnet acting on the reed switch is of insufficient strength to close such switch so that the circuit for the microphone is made and voice transmission is maintained. Upon inhalation by the wearer, the air stream impinges on the magnet assembly to move the magnet against the bias of the coil spring to a position adjacent the reed switch such that the magnetic field interacts with the reed switch to open the circuit disabling the microphone.

However, such deactivation device is quite sensitive to adjustment. For instance, the strength of the spring must be adjusted so that the switch is opened by the magnet during the inhalation by the wearer. As the man skilled in the art knows, the strength of a spring may vary as the time goes and, therefore, the spring must be adjusted regularly during maintenance operation.

Therefore, it would be advantageous to achieve a breathing mask having microphones therein, which has a deactivation device sensitive to the noise so that such noise is not picked up by the microphone, the deactivation device being reliable and not prone of disturbance.

To better address one or more concerns, in a first aspect of the invention, a breathing mask adapted to be placed over a wearer's face, comprises

- a mask body including a gas inlet port to be disposed in flow communication with the wearer's breathing passage for flow of a gas in a predetermined flow stream there through upon inhalation by the wearer;
- a communications microphone mounted to said mask body to capture the voice of the wearer, said communications microphone generating sound signals;
- an attenuation device for attenuating said sound signals;
- a sound monitor for monitoring the intensity of sound near the communications microphone in a predetermined frequency range, connected to
- a controller for activating the attenuation device when the sound intensity monitored by the sound monitor is in a predetermined level range.

The breathing mask having no mechanical part to attenuate the inhaling noise has a very stable operation and does not require adjustment during maintenance operation.

In a particular embodiment, the breathing mask comprises a second sound monitor for monitoring sounds having voiced speech frequencies. If such a sound is detected, it is considered as wearer's speech and the sound signals are not attenuated even if other sounds are detected by the first sound monitor. The embodiment has the advantage to transmit voice in all circumstances, even if breathable air is flowing into the mask.

In another embodiment, the sound monitor monitors the sound signals generated by the communications microphone. This embodiment has the advantage to reduce costs by minimizing the number of parts of the breathing mask.

These and other aspects of the invention will be apparent from and elucidated with reference to the embodiment described hereafter where:

In the following description, like reference numerals will be used to refer to like or corresponding elements in the different figures of the drawings.

Figure 1:
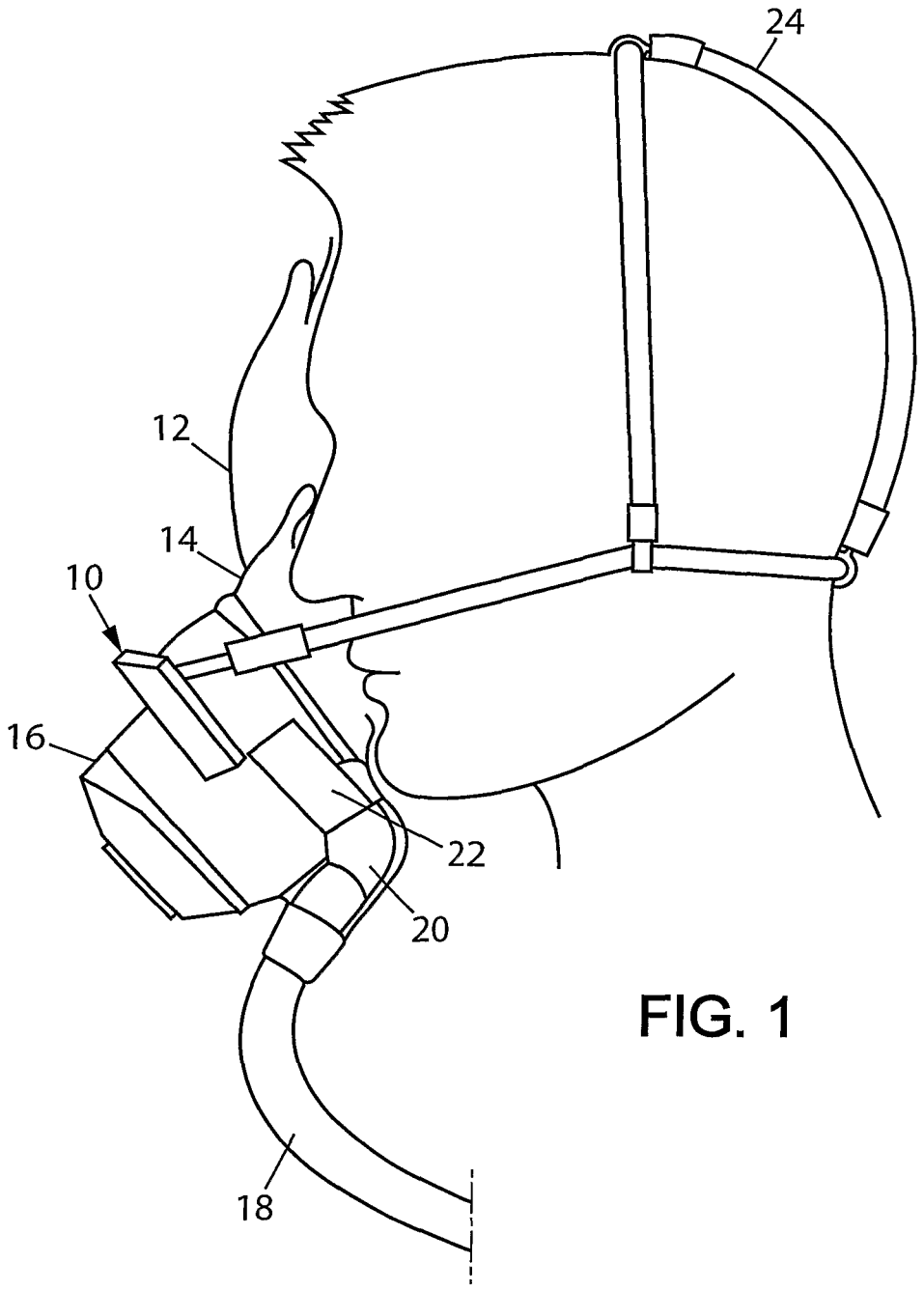
FIG. 1 is a diagrammatic side view of an aircraft breathing mask on a flight crew member including therein a microphone assembly and noise attenuation device in accordance with the present invention.

Referring to FIG. 1, a full face mask 10 for use by an aircraft flight crew is provided and includes a lens 12 sealingly moulded into a mask body 14 for sealing engagement against the wearer's face. The mask body is moulded with a projecting regulator housing 16 that houses therein a conventional demand regulator assembly (not shown) for delivering breathable air such as oxygen or an oxygen/air mixture at an appropriate delivery pressure.

The regulator housing receives breathable gas under pressure from a pressurized gas source by way of an inlet hose 18 and fitting 20 coupled to the regulator housing. In addition, the regulator housing has mounted thereto a microphone assembly, generally indicated at 22, nested within the mask body to convert sounds received from the wearer into audio signals for transmission to other crew members and to the control tower.

An adjustable harness strap 24 is attached to the mask and mask body for conveniently adjusting the face mask conformably over the wearer's head when in use.

Figure 2:
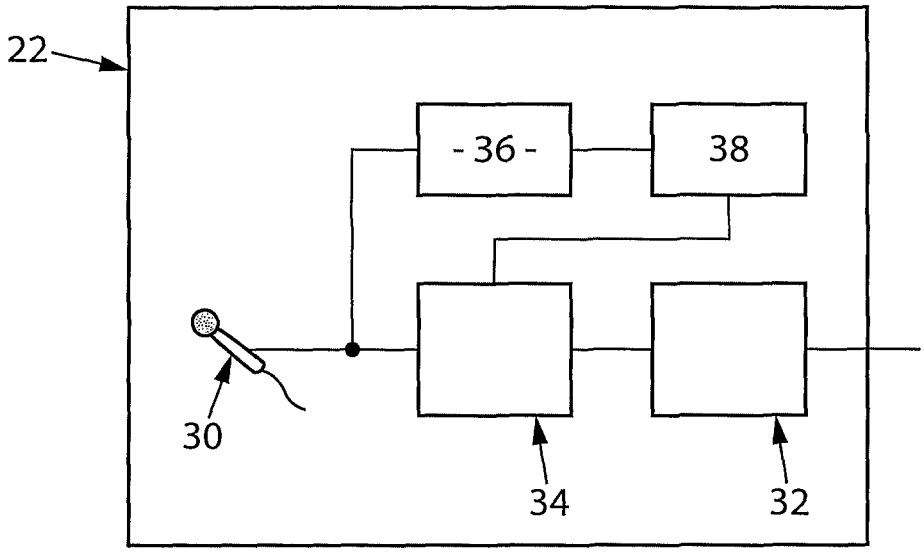
FIG. 2 is a schematic view of a first embodiment of a microphone assembly of the breathing mask of FIG. 1.

Referring to FIG. 2, the microphone assembly 22 includes a microphone 30 connected to a transmitter 32 for transmission of audio signals to other crew members and to the control tower.

Between the microphone 30 and the transmitter 32, an attenuation device 34 is connected so that the audio signals to be transmitted can be attenuated.

The attenuation device 34 comprises at least two modes of operation. The first mode is a "pass-through" mode in which it does not modify the sound signals coming from the microphone 30. And the second mode is an "attenuation" mode in which it attenuates the sound signals coming from the microphone.

The attenuation device may be a switch and the attenuation mode consists to switch off the sound signals. Or the attenuation device may be an electronic component or a piece of software designed to reduce the intensity of sound signals in attenuation mode.

A sound monitor 36 is connected at the output of the microphone 30, in parallel with the attenuation device 34.

The output of the sound monitor 36 is directed toward the input of a controller 38 which controls the attenuation device 34.

Figure 3:
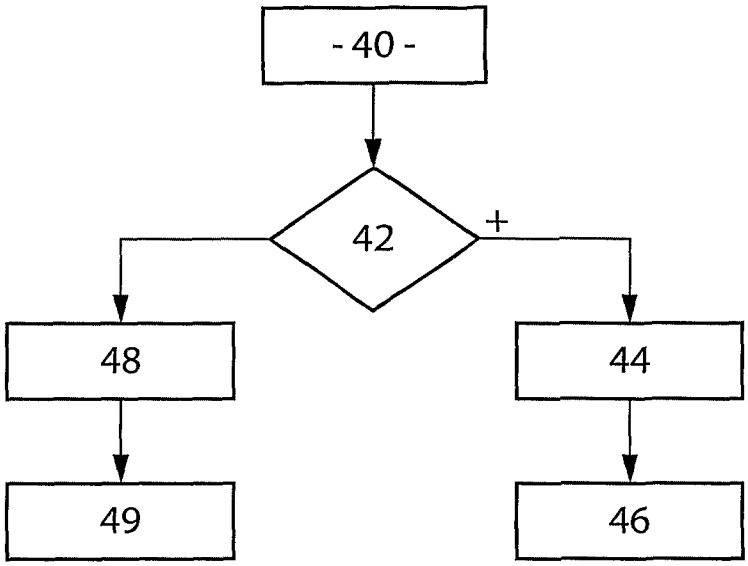
FIG. 3 is a flow diagram of the operation of the microphone assembly of FIG. 2.

Referring to FIG. 3, the microphone assembly works as follows. At step 40, the microphone 30 captures sounds inside the breathing mask. The sounds may be the wearer's voice, the noise from the breathable gas regulator during an inhalation phase or any noise coming from the surroundings.

The frequency bandwidth of a voiced speech is approximately from 300 Hz to 3000 Hz. For instance, in telephony, the usable voice frequency band ranges from approximately 300 Hz to 3400 Hz.

99% of the power of a voiced speech is below the 3000 Hz level.

Therefore, it may be considered that any sound having some intensity in a frequency range above the 3000 Hz is not part of a voiced speech, but a parasitic sound or noise.

Therefore, at step 42, the sound monitor 36 analyses the sound captured by the microphone in which a predetermined frequency range is outside the voiced speech frequency range. For instance, sound monitor 36 analyses the range of frequency above 10 kHz.

If, in the predetermined frequency range, a sound is detected at a certain level, i.e. above a determined intensity, for instance, above 60 dBa, it may be considered that the microphone is capturing a parasitic noise.

A spectral analysis of the noise generated by the inhaling gas in a breathing mask has shown that this noise is similar to a white noise, i.e. it has approximately the same intensity along a large frequency range. The analysis shows particularly a high-intensity component above 10 kHz.

Therefore, if the sound monitor detects a sound with frequencies above 10 kHz and with intensity above 60 dBa in this frequency range, it can be deduced that the sound is coming from the inhaling gas.

When the sound monitor detects, step 44, such a sound, it sends a signal to the controller 38. At reception of the signal, the controller 38 activates, step 46, the attenuation device with the effect that the transmitted sound signals are attenuated during the detection of the noise coming from the inhaling gas.

If no sound is detected in this frequency range, the sound monitor 44 sends step 48 a second signal to the controller 38 which deactivates, step 49, the attenuation device, i.e. which puts the attenuation device in "pass-through" mode.

Figure 4:
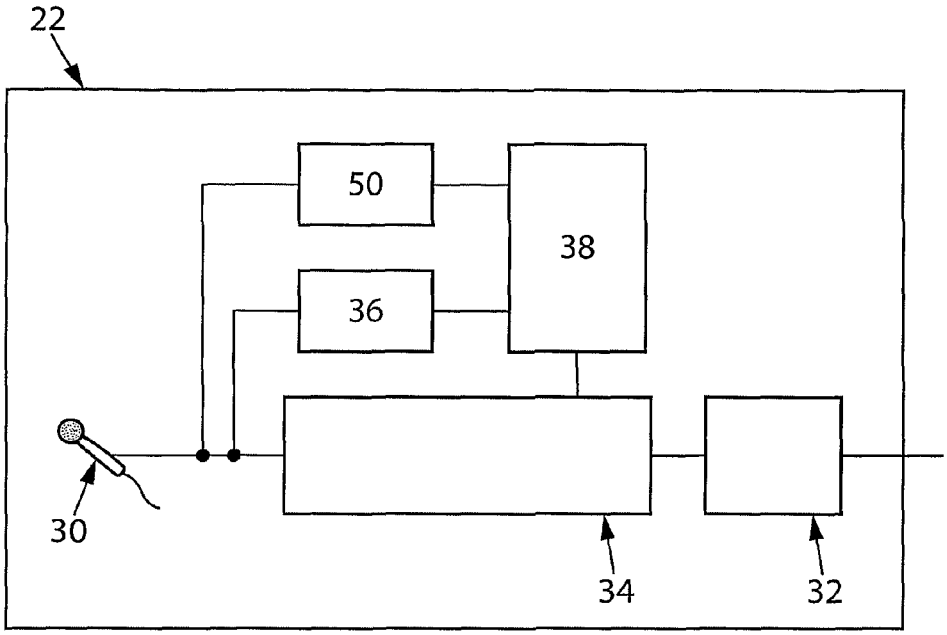
FIG. 4 is a schematic view of a second embodiment of a microphone assembly of the breathing mask of FIG. 1.

In a second embodiment, FIG. 4, a second sound monitor 50 is connected in parallel with the sound monitor 38 at the output to the microphone 30.

The second monitor 50 is set up to detect a sound in a frequency range used by the voiced speech. For instance, it detects sounds in a range below 500 Hz. If a sound in this frequency range is detected as having intensity above a second predetermined level, for instance 60 dBa, it is deduced that the wearer is speaking. Therefore, the controller 38 is setup to not activate the attenuation device, even if the sound monitor 36 detects a noise from the inhaling gas, i.e. in the first predetermined frequency range.

Figure 5:
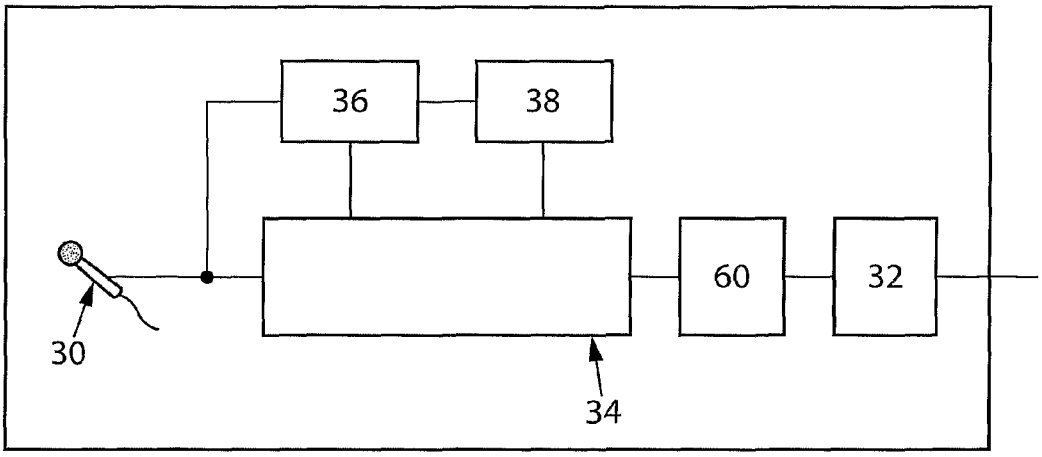
FIG. 5 is a schematic view of a third embodiment of a microphone assembly of the breathing mask of FIG. 1.

In a third embodiment, FIG. 5, a filter 60 is installed between the attenuation device and the transmitter 32. The filter 60 is a band pass filter with a bandwidth inside the voiced speech bandwidth, i.e. from 300 Hz to 3000 Hz. Therefore, even when the attenuation device is in a "pass-through" mode, parasite noises are eliminated by the filter 60.

While the invention has been illustrated and described in details in the drawings and foregoing description, such illustration and description are to be considered illustrative or exemplary and not restrictive; the invention is not limited to the disclosed embodiment.

For instance, the sound monitors may be connected to a second microphone having an acoustic response different from the microphone 30.

The microphone 30 may be selected to be particularly sensitive to voice signals and with few distortions inside the voice bandwidth. And the second microphone may be chosen to obtain a wide bandwidth response but without any requirement concerning the distortion.

The microphone assembly may be developed as an electronic printed board using discrete analogue components such as filter, operational amplifiers used to amplify the signals and to compare them with predetermined levels, and logic components to control the board behaviour.

It may also be developed as a digital board or a mixed analog/digital board, using software and digital signal processor (DSP) to embody the functions described here above.

For instance, an analog-to-digital converter may convert the signals outputted by the microphone 30 into a flow of integers representative of the captured sounds.

The flow of integers is processed by a software-managed processor to analyse the characteristics of the captured sounds and determine the attenuation to apply as explained here above.

The invention claimed is:

1. An assembly comprising:

a. a breathing mask (i) adapted to be placed over a wearer's face and (ii) comprising a mask body and a communications microphone assembly, the mask body comprising a regulator housing including a gas inlet port to be disposed in flow communication with the wearer's breathing passage for flow of a gas in a predetermined flow stream therethrough upon inhalation by the wearer and the communications microphone assembly (A) being mounted to the mask body and (B) comprising a microphone;

b. an attenuation device (i) electrically connected to the microphone and (ii) configured for operation at least:

(A) in a first mode in which it does not modify sound signals coming from the microphone; and (B) in a second mode in which it attenuates all sound signals coming from the microphone having a frequency range of voiced speech;

c. a sound monitoring system comprising a first sound monitor and a second sound monitor electrically connected to the microphone, the first sound monitor being configured to monitor a first intensity of sound near the microphone in a first frequency range outside the frequency range of voiced speech and analyze the first monitored sound intensity to determine whether it is in a first predetermined level range set to detect parasitic noise, and the second sound monitor being configured to monitor a second intensity of sound near the microphone in a second frequency range and analyze the second monitored sound intensity to determine whether it is in a second predetermined level range set to detect speech sound; and d. a controller configured to operate the attenuation device:

(A) in the first mode (i) when the first monitored sound intensity analyzed by the first sound monitor is not in the first predetermined level range or (ii) when the second monitored sound intensity analyzed by the second sound monitor is in the second predetermined level range; and (B) in the second mode (i) when the first monitored sound intensity analyzed by the first sound monitor is in the first predetermined level range and (ii) when the second monitored sound intensity analyzed by the second sound monitor is not in the second predetermined level range.

2. The assembly according to claim 1 wherein the first frequency range is above 3 kHz.

3. The assembly according to claim 2 wherein the first frequency range is above approximately 10 kHz and the first predetermined level range is above approximately 60 dBa.

4. The assembly according to claim 1 wherein the second frequency range is below approximately 500 Hz.

5. The assembly according to claim 4 wherein the second predetermined level range is above approximately 60 dBa.

6. The assembly according to claim 1 wherein the first and second sound monitors monitor sound signals generated by the microphone.

7. The assembly according to claim 1 further comprising a filter to filter out the sound signals having a frequency outside a voiced speech frequency band in the second mode of the attenuation device.

8. The assembly according to claim 1 wherein, in the second mode, the attenuation device switches off the sound signals.

9. The assembly according to claim 1 further comprising a band-pass filter with a bandwidth between 300-3000 Hz electrically connected to the attenuation device.

10. The assembly according to claim 1 further comprising a lens sealingly molded into the mask body.

11. The assembly according to claim 1 further comprising an adjustable harness strap attached to the mask body.

12. An assembly comprising:

a. a breathing mask (i) adapted to be placed over a wearer's face and (ii) comprising a mask body and a communications microphone assembly, the mask body comprising a regulator housing including a gas inlet port to be disposed in flow communication with the user's breathing passage for flow of a gas in a predetermined flow stream therethrough upon inhalation by the wearer and the communications microphone assembly (A) being mounted to the mask body and (B) comprising a microphone and a transmitter;

b. an attenuation device (i) electrically connected to the microphone and between the microphone and the transmitter and (ii) configured for operation at least:

(A) in a first mode in which it does not modify sound signals coming from the microphone; and (B) in a second mode in which it attenuates all sound signals coming from the microphone having a frequency range of voiced speech;

c. a sound monitoring system comprising a first sound monitor and a second sound monitor electrically connected to the microphone in parallel with the attenuation device, the first sound monitor being configured to monitor a first intensity of sounds directly or indirectly due to the wearer near the microphone in a first predetermined frequency range above 3 kHz outside the frequency range of voiced speech and analyze the first monitored sound intensity to determine whether it is in a first predetermined level range set to detect parasitic noise, and the second sound monitor being configured to monitor a second intensity of sound in a second predetermined frequency range and analyze the second monitored sound intensity to determine whether it is in a second predetermined level range set to detect speech sound; and d. a controller (i) electrically connected to and between the sound monitoring system and the attenuation device and (ii) configured to operate the attenuation device:

(A) in the first mode (i) when the first monitored sound intensity analyzed by the first sound monitor is not in the first predetermined level range or (ii) when the second monitored sound intensity analyzed by the second sound monitor is in the second predetermined level range; and (B) in the second mode (i) when the first monitored sound intensity is in the first predetermined level range and (ii) when the second monitored sound intensity analyzed by the second sound monitor is not in the second predetermined level range.

13. A method for avoiding interference in communications between crewmembers provided with breathing assemblies or between a crewmember provided with a breathing assembly and a control tower, wherein at least one assembly comprises a breathing mask (a) adapted to be placed over a crewmember's face and (b) comprising (i) a mask body comprising a regulator housing including a gas inlet port to be disposed in flow communication with the crewmember's breathing passage for flow of a gas in a predetermined flow stream therethrough upon inhalation by the crewmember, (ii) a communications microphone assembly mounted to the mask body and including a microphone, and (iii) an attenuation device electrically connected to the microphone, the method comprising:

(A) monitoring a first intensity of sound near the microphone in a first frequency range outside a frequency range of voiced speech and analyzing the first monitored sound intensity to determine whether it is in a first predetermined level range set to detect parasitic noise;

(B) monitoring a second intensity of sound near the microphone in a second frequency range and analyzing the second monitored sound intensity to determine whether it is in a second predetermined level range set to detect speech sound; and (C) when the first monitored sound intensity analyzed by the first sound monitor is not in the first predetermined level range, or when the second monitored sound intensity analyzed by the second sound monitor is in the second predetermined level range, not attenuating the sound signals coming from the microphone; and when the first monitored sound intensity analyzed by the first sound monitor is in the first predetermined level range and the second monitored sound intensity analyzed by the second sound monitor is not in the second predetermined level range, attenuating all sound signals coming from the microphone having the frequency range of voiced speech.

* * * * *